US006878023B2

(12) United States Patent
Muser

(10) Patent No.: US 6,878,023 B2
(45) Date of Patent: Apr. 12, 2005

(54) LENGTH-ADJUSTABLE TOPSTAY FOR RIGGERS

(76) Inventor: Christoph Muser, 24503 SE. 44th St., Issaquah, WA (US) 98029

( * ) Notice: Subject to any disclaimer, the term of this patent is extended or adjusted under 35 U.S.C. 154(b) by 0 days.

(21) Appl. No.: 10/617,621

(22) Filed: Jul. 11, 2003

(65) Prior Publication Data

US 2005/0009421 A1 Jan. 13, 2005

(51) Int. Cl.[7] ..... B63H 16/067
(52) U.S. Cl. ..... 440/105
(58) Field of Search ..... 440/104–110

(56) References Cited

U.S. PATENT DOCUMENTS 271,441 A * 1/1883 Fearon ..... 440/105
5,873,757 A * 2/1999 Van Balen ..... 440/105

FOREIGN PATENT DOCUMENTS

AU 149153 * 11/1950 ..... 440/105
JP 63-192692 * 8/1963 ..... 440/105

* cited by examiner

*Primary Examiner*—Sherman Basinger
(74) *Attorney, Agent, or Firm*—Dean A. Craine

(57) ABSTRACT

A telescoping topstay for a rigger that includes a length adjustable tubular member with a diagonally aligned tubular housing attached at its distal end. Attached to one end of the tubular housing is a pin connector that attaches by a bolt to the top end of the oarlock pin. Attached to the proximal end of the tubular member is a transversely aligned pivot connector that connects to a base bracket attached to the sides of the boat hull. The pin connector is able to selectively rotate and lock in a desired position on the tubular housing. The pivot connector is able to axially rotate over the proximal end of the tubular member. During use, the orientations of the pin and the pivot connectors are selectively adjusted so that they match the respective mating surfaces on the oarlock pin and boat hulls.

5 Claims, 4 Drawing Sheets

LENGTH-ADJUSTABLE TOPSTAY FOR RIGGERS

BACKGROUND OF THE INVENTION

1. Field of the Invention

The present invention relates to riggers for rowing and sculling boats and, more specifically, to topstays used with riggers.

2. Description of the Related Art

Narrow rowing and sculling boats such as racing shells, are typically equipped with laterally extending riggers used to support oarlocks outboard of the boat hull. Riggers transfer the principle load from the oarlock pin to the boat hull structure. The oarlock pin is fixed rigidly to the rigger, seats the oarlock, and extends generally upward and vertically from the rigger. The load introduced during a rowing stroke causes the rigger and the oarlock pin to deflect. Topstays, which attach typically by means of bolts and nuts at their outer end to the top of the oarlock pin and at their inner end to the boat hull, are commonly used to reduce such undesirable deflection.

The oarlock pins generally can be moved in the lateral direction of the boat to vary the rower's leverage on the oar. In some cases, the oarlock pin can be moved in the longitudinal direction of the boat to change a rower's position front and aft, relative to the oarlock pin. It is also common for oarlock pins to be tilted in the longitudinal direction of the boat and also in the lateral direction of the boat, to set the desired pitch angles for the oar blade as it moves through the water. Because the rigger is a rigid structure and because the position of the oarlock may be adjusted in the manner described, it becomes essential that the topstays, which attach at their outer end to the top of the oarlock pin and attach at their inner end to the boat hull, be adjustable to accommodate the new position of the top end of the oarlock pin relative to the topstay attachment point at the boat hull.

Typically, length-adjustable topstays comprise two tubular members which telescope and are secured with clamps or which are connected with a turnbuckle. In most cases, the outer tubular member connected to the top of the oarlock pin can be rotated around its longitudinal axis relative to the inner tubular member which attaches to the boat hull and thus provides some additional but limited adjustability. Typically, the inner and outer attachment point surfaces of the topstay are created by flattening the corresponding tube ends and by shaping and bending the flattened tube ends to match the mating surfaces at the top end of the oarlock pin and on the boat hull. The manufacturing method to create the flattened tube ends on the topstay is inherently inaccurate and yields topstays which, in the best-case, fit the mating surfaces at the top end of the oarlock pin and the boat hull only for one specific position of the oarlock pin. When the oarlock pin is moved into a position other than this best-case position, the attachment surfaces of the topstay do not match the mating surfaces at the top of the oarlock pin and at the boat hull. When the bolts and nuts are used to attach the topstay to the oarlock pin and the boat hull, unwanted stresses are introduced.

These unwanted stresses can damage the boat hull at the attachment point for the topstay. Further, depending on the boat hull construction, such unwanted stresses can bend and deflect the boat hull and thus cause greater damage and form cracks in the boat hull. In addition, such unwanted stresses bend and deflect the oarlock pin and the rigger, thus changing the desired settings for the oar pitch and increasing the danger of snapping off an oarlock pin.

Conventional topstays have various mechanisms to adjust their lengths which generally fall into two categories. Topstays with a length adjusting mechanism of the first category have one tubular member of the topstay sliding into a larger diameter tubular member of the topstay which has at least two axial cuts at its end so that it can be tightened onto the inner tubular member by means of hose clamps. This simple mechanism relies on friction and there is no guarantee that any length position is positively secured. To overcome this drawback, circumferential grooves are formed on the outer surface of the smaller diameter tubular member for the outer tubular member to bite into when tightened. While this provides a secure length adjustment, the length adjustment is now incremental and not continuous. Topstays with a length adjusting mechanism of the second category have a threaded connection between the two tubular members with the smaller diameter tubular member threading into the larger diameter tubular member. While this provides a simple and secure length adjusting mechanism, the length adjustment can only be done incrementally, one full 360-degree turn at a time. The size of the increment corresponds to the pitch chosen for the thread. To keep the secure length adjustment of a threaded connection but to gain continuous adjustability, it is common to unite the two tubular members of the topstay with a somewhat unwieldy and heavier turnbuckle arrangement.

With their outer attachment point surfaces created by flattening and bending the outer ends of its tubular telescoping members, conventional topstays are typically asymmetric with respect to the side they attach to on the row or sculling boat hull. With port and starboard topstays not interchangeable, additional spare parts are necessary in case a topstay must be replaced.

The present invention substantially departs from the conventional concepts and designs of the prior art, and in so doing provides a topstay for rowing or sculling boat riggers adjustable in such a way that the surfaces of its outer end and its inner end always match the respective mating surface at the top end of the oarlock pin and at the boat hull, thus eliminating unwanted stresses and the related deformation and damage to the boat hull and the related deformation of the oarlock pin and of the rigger.

SUMMARY OF THE INVENTION

It is an object of the present invention to provide an improved, length adjustable topstay for a rigger.

It is another object of the invention to provide such a topstay that can be used on the port and starboard side of the hull.

It is a further object of the present invention to provide such a topstay that does not create excessive stress on the hull and the oarlock pin when the oarlocks are moved in different locations on the riggers.

These and other objects are met by the topstay presented herein that comprises an outer and inner tube member, longitudinally aligned and telescopically connected together. Formed on the distal end of the outer tube member is a transversely aligned tubular housing that receives a pin connector. In the preferred embodiment, the tubular housing is aligned approximately 45 degrees to the longitudinal axis of the outer tubular member. During assembly, the pin connector is selectively rotated and then fixed inside the tubular housing. The pin connector is then connected to the oarlock pin.

Inserted into the proximal end of the inner tubular member is a cylindrical plug. Perpendicularly aligned and attached to the cylindrical plug is a pivot connector. During assembly, the base bracket is securely attached to the boat hull. The pivot connector is transversely aligned over the base bracket and suspended between two bores formed on the base bracket. The topstay is then pivoted over the base bracket and axially rotated so that the pin connector may be properly aligned on the oarlock pin.

Before explaining at least one preferred embodiment of the invention in detail, it is to be understood that the invention is not limited in its application to the details of construction and to the arrangements of the individual components set forth in the following description or illustrated in the drawings. The invention is capable of other embodiments and of being practiced and carried out in various ways. In particular, an embodiment comprising a conventional topstay and only one additional joint at its inner end as described for this invention, will have marked advantages over a state of the art topstay by eliminating most undesirable stresses exerted onto the boat hull by a conventional topstay without aforesaid joint and thus in effect eliminating most stress induced damages to the boat hull.

DESCRIPTION OF THE PREFERRED EMBODIMENT(S)

Figure 1:
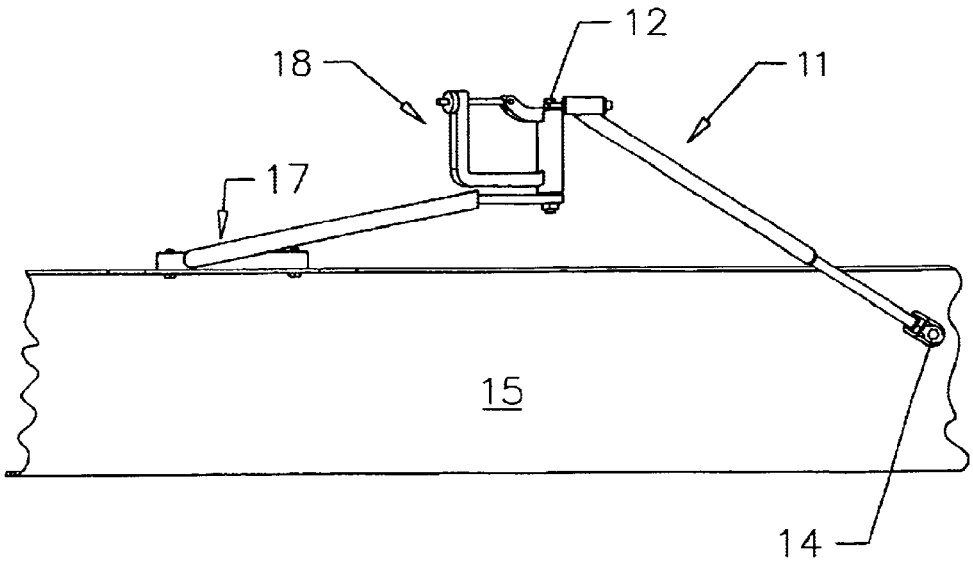
FIG. 1 is a side elevational view of the row or sculling boat rigger with one embodiment of a topstay installed.
Figure 2:
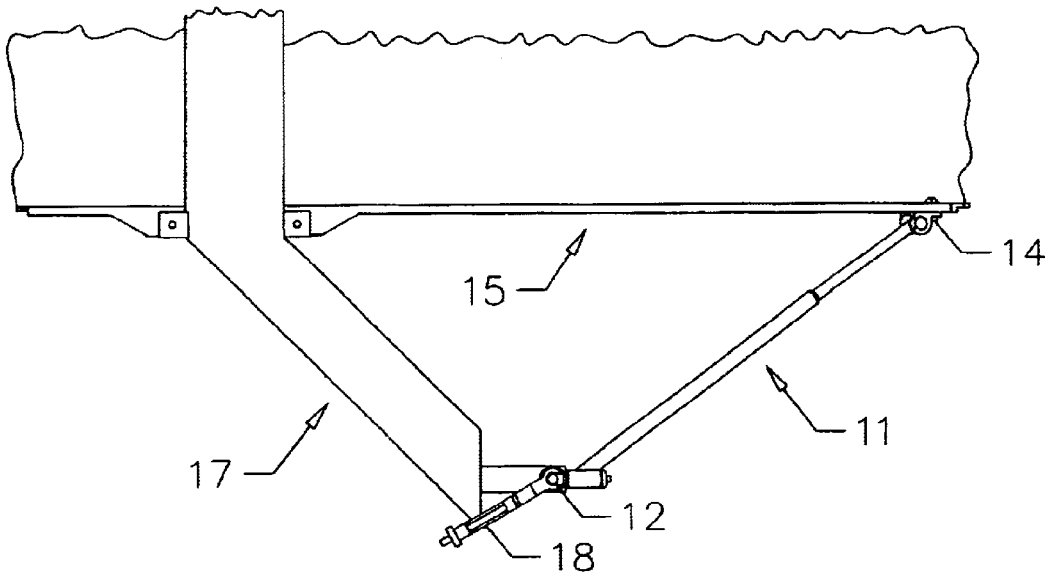
FIG. 2 is a top plan view of the row or sculling boat rigger shown in FIG. 1.

Referring to the drawings, and particularly to FIGS. 1 and 2, a topstay 11 according to the present invention is secured at its distal end by a bolt 12, to the top end of the oarlock pin 13 and is secured at its proximal end by bolt 14 to the indicated boat hull 15. The bottom of the oarlock pin 13 is depicted as being secured by a nut 16 to the rigger 17 attached to the boat hull 15. An oarlock 18 is shown in phantom lines for clarity.

Figure 3:
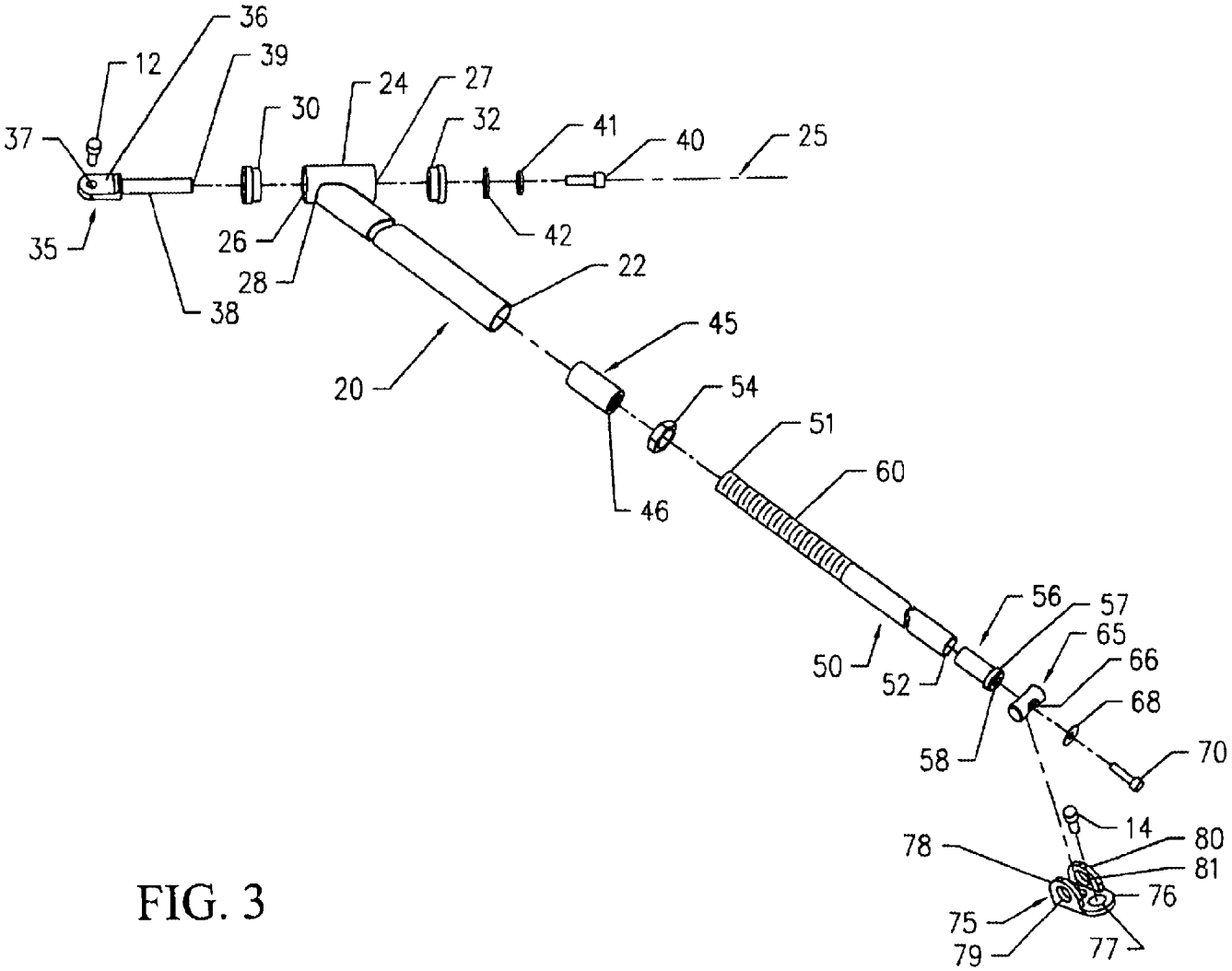
FIG. 3 is an exploded perspective view of one embodiment of a topstay shown in FIGS. 1 and 2.

As shown in FIG. 3, the topstay 11 comprises an outer tubular member 20 made of metal, preferably aluminum. Attached via a weld 28 to the distal end of the tubular member 20 is a short, fixed tubular housing 24, also, made of metal, preferably aluminum. The tubular housing 24 is diagonally aligned on the tubular member 20 so that the longitudinal axis 25 of the tubular housing 24 intersects the longitudinal axis 23 of the outer tubular member 20 at an angle other than zero, preferably at or near 45 degrees.

Inserted into the opposite ends 26, 27 of the tubular housing 24 are two identical plugs 30 and 32. Plugs 30, 32 are made of lightweight material, preferably a plastic such as nylon and act as seats for the pin connector 35 and bolt 40. The pin connector 35 includes a flat end surface 36 formed on one end and a cylindrical neck 38 found on the opposite end. A hole 37 is drilled in the flat end surface 36 of the pin connector 35 which receives a bolt 12 for securing it to the top end of the oarlock pin 13. Formed longitudinally inside the cylindrical neck 38 is a threaded bore 39 that connects to bolt 40 when longitudinally aligned and extended into the central passageway formed inside the tubular housing 24. A lock washer 41 may be disposed over the bolt 40 to prevent the bolt 40 from loosening. A flat washer 42 is also added to protect the plug 32 from being marred by the lock washer 41.

Figure 4:
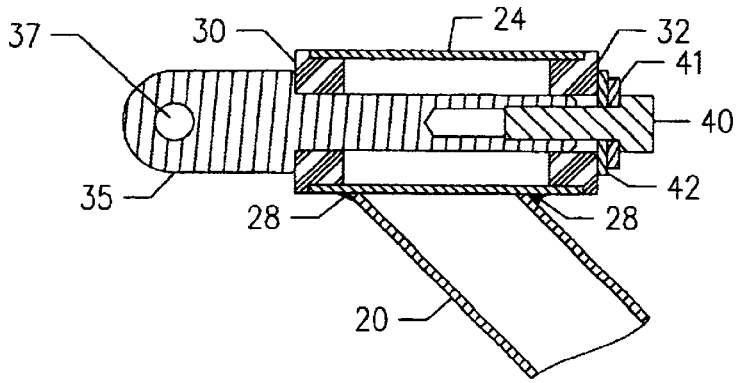
FIG. 4 is a cross section view of the outer end of one embodiment of a topstay.

The pin connector 35, the tubular housing 24 and bolt 40 comprise a first joint on the topstay 11. Referring to FIG. 4, by loosening bolt 40, the pin connector 35 can be rotated around its longitudinal axis and when the correct setting has been achieved, tightening the bolt 40 fixes the position of pin connector 35 inside the tubular housing 24.

Inserted and fixed in the proximal end 22 of the outer tubular member 20 is a sleeve 45. The sleeve 45 includes a longitudinally aligned threaded bore 46 that selectively connects to the external threads 60 formed on the distal end 51 of the inner tubular member 50. The sleeve 45 is made of suitable material capable of being welded or bonded to the outer tubular member 20.

The inner tubular member 50 has a external threads 60 formed near its distal end 51 that connect to threaded bore 46 formed on the sleeve 45. The inner tubular member 50 is made of metal preferably aluminum and the length of its external threads is determined by the desired range over which the length of the topstay 11 can be adjusted. A jam nut 54 is attached to the threads 60 and enables the user to lock the inner tubular member 50 in a desired length of the outer tubular member 20.

Inserted into the proximal end 52 of the inner tubular member 50 is a plug 56. The plug 56 includes a wide flange surface 57 that extends over the proximal end 52 when the plug 56 is inserted into the inner tubular member 50. Formed inside the plug 56 is a threaded bore 58. The plug 56 is secured to the inner tubular member 50 by either bonding or welding, depending on the material choice and preference.

Aligned transversely over the flange surface 57 of the plug 56 is a cylindrical pivot connector 65. Extending transversely through the center axis of the pivot connector 65 is a non-threaded bore 66. The bore 66 is countersunk at its opposite ends to improve seating for the plug 56 and for a spring washer 68 as shown in FIG. 3. During assembly, a bolt 70 extends through the pivot connector 65 and connects to the threaded bore 58 formed in the plug 56. The spring washer 68 is placed around the bolt 70. The pivot connector 65 is then secured to the proximal end 52 of the inner tubular member 50 by the means of bolt 70. During the process of tightening bolt 70, spring washer 68 is not fully compressed to allow axial rotation of the inner tubular member 50 with respect to the pivot connector 65.

Also shown in FIG. 3, the proximal end 52 of the inner tubular member 50 is connected to a base bracket 75. The base bracket 75 includes a flat plate 76 with two upward extending arms 78, 80. A main hole 77 is formed on the flat plate 76 that receives a bolt 14 to attach the base bracket 75 to the boat hull. Formed on the arms 78, 80 are holes 79, 81, respectively, designed to receive and hold the pivot connector 65 transversely over the base bracket 75. During assembly, the pivot connector 65 is extended between the two holes 79, 81 to attach the distal end of the topstay to the base bracket 56.

It should be understood that the plug 56, pivot connector 65, and base bracket 75 make a second joint formed on the topstay 11 that allows the user to diagonally align the topstay over the base bracket 75.

With proper modifications known to one skilled in the art at least a portion of the outer tubular member 20 and the inner tubular member 50, can be made of composite material such as polymeric resin reinforced with fibers.

During assembly, the overall length of the topstay 11 must be precisely adjusted. This is achieved by providing a means for continuous adjustment of the length with a single thread joint between the outer tubular member 20 and the inner tubular member 50. The bolt 70 is sufficiently tightened only to the point at which the inner tubular member 50 can still be rotated by hand over the base bracket 75. The spring washer 68 ensures a tight joint and bolt 70 can comprise a nylon patch preventing it from loosening.

To properly align the pin connector 35 on the oarlock pin 13, the bolts 14, 40 and jam nut 54 are loosened. While supporting the tubular housing 24, the inner tubular member 50 is manually rotated until the hole 37 of the pin connector 35 is aligned with the hole (not shown) in the top of the oarlock pin 13. Bolt 12 is then inserted into the hole 37 and finger-tightened. Bolt 14 is then tightened completely. At this point it might be necessary to make further slight adjustments to the length by turning the inner tubular member 50 before tightening bolt 12, then bolt 40 and jam nut 54.

Figure 5:
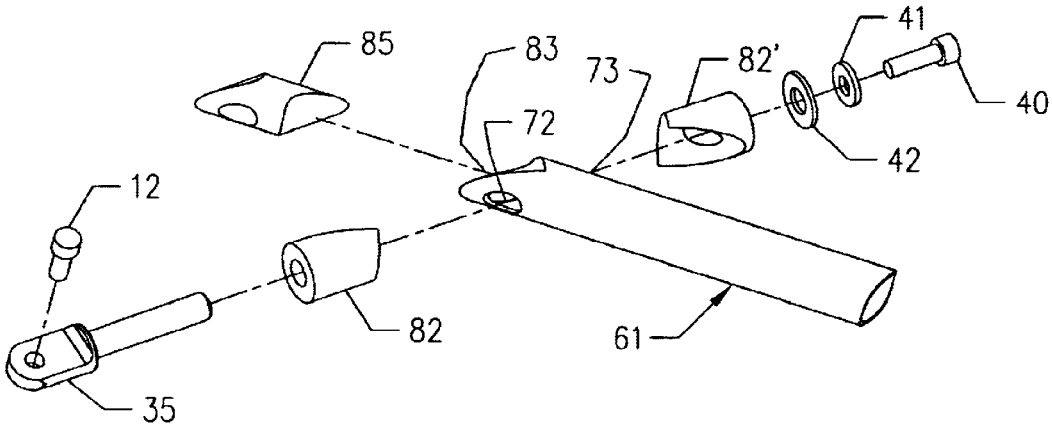
FIG. 5 is an exploded perspective view of a second embodiment of the outer end of the topstay.
Figure 6:
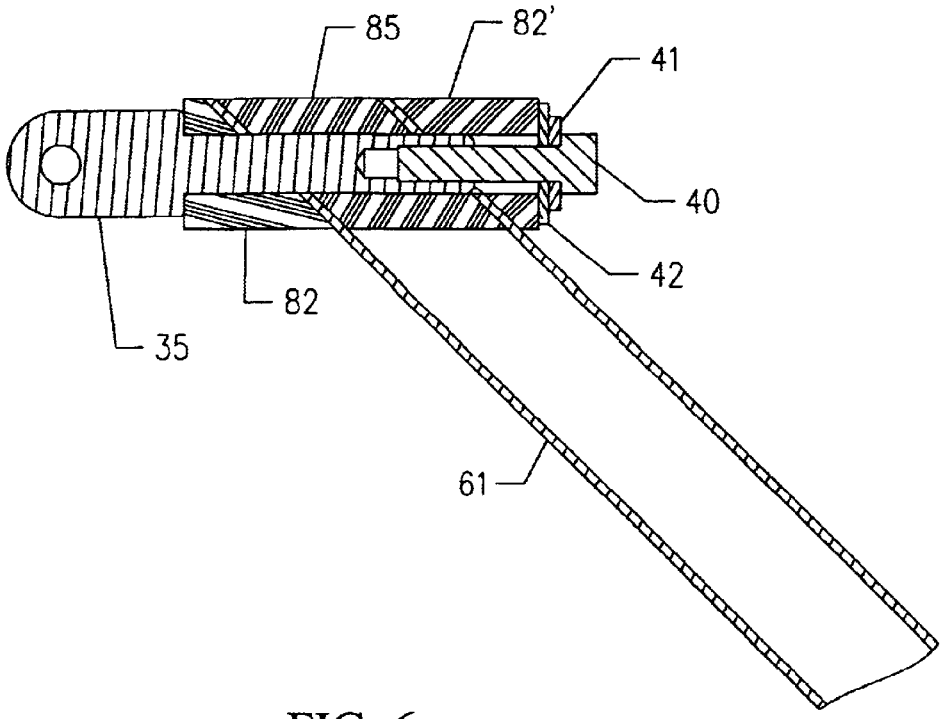
FIG. 6 is a cross section view of the outer end of the second embodiment of the topstay shown in FIG. 5.

A second embodiment for the first joint is depicted in FIG. 5 and FIG. 6, which shows the pin connector 35 seated directly in the modified outer tubular member 61. The tubular housing 24 is formed by two identical spacers 82 and 82' diagonally cut and contoured on one side to fit the outer diameter of the outer tubular member 61 so that the pin connector 35 is diagonally aligned at approximately 45 degrees with respect to the modified outer tubular member 80. The opposite surfaces of the spacers 82, 82' are squared off to properly support pin connector 35 and bolt 40 with its lock washer 41 and its washer 42. The modified outer tubular member 61 includes an end opening 83 in which an end plug 85 is inserted. Formed on the end plug 85 is a transversely aligned bore 86. The end plug 85 is contoured to close the outer tubular member 61 and to provide stiffness to this outer joint and to the cross section of the modified outer tubular member 61 when bolt 40 is tightened. Formed on the distal end of the modified tubular member 61 are two holes 72, 73 that enable the plug connector 35 and bolt 40 to extend through and connect together. The adjustments for pin connector 35 are done identically as described for the first embodiment described above and as shown in FIG. 3 and FIG. 4.

It should be understood that the topstay 11 could include only the plug connector 35 that connects to the outer tubular members 20 and 61. The topstay 11 could also include a fixed plug connector as used in the prior art and the plug 56, pivot connector 65, and base bracket 75 as described herein. In the preferred embodiment, however, the topstay 11 includes both joints along with the telescoping adjustment feature.

In compliance with the statute, the invention described herein has been described in language more or less specific as to structural features. It should be understood, however, that the invention is not limited to the specific features shown, since the means and construction shown is comprised only of the preferred embodiments for putting the invention into effect. The invention is therefore claimed in any of its forms or modifications within the legitimate and valid scope of the amended claims, appropriately interpreted in accordance with the doctrine of equivalents.

I claim:

1. A topstay for rowing or sculling boat riggers comprising:

a. an outer tubular member and an inner tubular member longitudinally aligned and telescopically connected together, said outer tubular member having a distal end and said inner tubular member having a proximal end;

b. a tubular housing diagonally aligned and attached to said distal end of said outer tubular member, said tubular housing including two opposite end openings;

c. a rotating pin connector inserted into one said end opening on said tubular housing, said pin connector capable of connecting to an oarlock pin on a rigger;

d. means for attaching said pin connector to said tubular housing and;

e. means for attaching said inner tubular member to a boat hull including a pivot connector selectively attached to said proximal end of said inner tubular member and a base bracket attached to a boat hull, said base bracket including means for holding said pivot connector in a transverse orientation thereby allowing said pivot connector to pivot over said base bracket when said base bracket is attached to a boat hull.

2. The topstay as recited in claim 1, wherein said tubular housing is formed by two longitudinally aligned hollow spacers near said distal end and on opposite sides of said outer tubular member.

3. The topstay as recited in claim 2, wherein said means for attaching said pin connector to said tubular housing is an end plug inserted into the distal end of said tubular member and a bolt that extends through one said spacer and said tubular housing and connects to said pin connector to hold said pin connector on said tubular housing.

4. The topstay as recited in claim 2, wherein said spacers are aligned near said distal end of said outer tubular member between 30 to 45 degrees.

5. The topstay as recited in claim 1, wherein said tubular housing is aligned between 30 to 45 degrees on said distal end of said outer tubular member.

* * * * *